US006484977B1

(12) United States Patent
Yu

(10) Patent No.: US 6,484,977 B1
(45) Date of Patent: Nov. 26, 2002

(54) MUSICAL INSTRUMENT STAND

(76) Inventor: Ming-Ti Yu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/933,240

(22) Filed: Aug. 17, 2001

(51) Int. Cl.[7] ..... A47F 5/00; G10D 3/00

(52) U.S. Cl. ..... 248/125.1; 248/125.8; 248/157; 84/327; 84/453

(58) Field of Search ..... 248/125.1, 125.8, 248/149, 150, 157, 413, 411; 84/327, 453, 329, 387 A, 280

(56) References Cited

U.S. PATENT DOCUMENTS 4,185,808 A * 1/1980 Donohoe et al. ..... 248/295.11
4,497,092 A * 2/1985 Hoshino ..... 24/271
4,561,339 A * 12/1985 Jensen ..... 248/441.1
4,744,690 A * 5/1988 Hsieh ..... 248/411
5,505,413 A * 4/1996 Hennessey ..... 248/166
5,713,547 A * 2/1998 Yu ..... 248/166
5,744,735 A * 4/1998 Liao ..... 84/327
5,836,552 A * 11/1998 Yu ..... 248/166
5,957,417 A * 9/1999 Yu ..... 248/166
5,959,225 A * 9/1999 Hsu ..... 84/327
6,005,176 A * 12/1999 Yu ..... 248/443
6,036,159 A * 3/2000 Yu ..... 224/910
6,113,040 A * 9/2000 Yu ..... 248/166
6,127,612 A * 10/2000 Yu ..... 84/327
6,209,829 B1 * 4/2001 Yu ..... 248/122.1
6,323,405 B1 * 11/2001 Yu ..... 84/327
6,388,180 B1 * 5/2002 Buttice-Cannon ..... 84/327
6,412,742 B1 * 7/2002 Yu ..... 248/434
2002/0070319 A1 * 6/2002 Yu ..... 248/122.1

* cited by examiner

*Primary Examiner*—Anita King
*Assistant Examiner*—Naschica S. Morrison

(57) ABSTRACT

A musical instrument stand has a pair of first leg devices, a pair of second leg devices, a pair of adjustment mounts, a main connector, a collar, a clamping device, and an adjustment tube. A first rivet fastens one of the first leg devices, one of the second leg devices, and one of the adjustment mounts together. A bolt fastens the main connector and one of the adjustment mounts together. The collar receives a lower sleeve of the clamping device. The clamping device receives an upper portion of the main connector. The adjustment tube is inserted through the clamping device and the main connector.

2 Claims, 13 Drawing Sheets

MUSICAL INSTRUMENT STAND

BACKGROUND OF THE INVENTION

The present invention relates to a musical instrument stand. More particularly, the present invention relates to a musical instrument stand which can be folded easily.

U.S. Pat. No. 5,713,547 has disclosed a guitar stand which has a main hollow rod, a first hollow leg, a second hollow leg, a first brace, a second brace, a first bracket, and a second bracket. A pivot means fastens the first hollow leg and the second hollow leg on the main hollow rod pivotally. A hollow upper block is disposed on top of the main hollow rod. The pivot means has a lobe, a transverse plate and a longitudinal plate which is disposed on top of the transverse plate. A main hollow rod has a lobe disposed on an upper portion of the main hollow rod. A circular hole and a curved hole are formed on the main hollow rod. A hollow upper block has a lower protrusion inserted in an upper end of the main hollow rod. A first and a second round cushions are disposed adjacent to a first and a second sides of the hollow upper block, respectively. The first round cushion has a first center hole. The second round cushion has a second center hole. A first bolt passes through the first center hole to fasten the first round cushion on the hollow upper block. A second bolt passes through the second center hole to fasten the second round cushion on the hollow upper block. A longitudinal plate is disposed on a top of the transverse plate. The longitudinal plate has an upper hole to match the corresponding circular hole and a lower hole to match the corresponding curved hole. A first fastening member passes through the circular hole and the upper hole and a second fastening member passes through the lower hole and the curved hole to fasten the lobe and the longitudinal plate together. A first and a second joints are disposed on the first and the second hollow legs, respectively. Each of the first and the second joints has a threaded lower portion inserted in a top interior of the corresponding hollow leg, an annular flange abutting the threaded lower portion, and a top recess to receive the transverse plate. A bevel is disposed beneath the top recess. A notch is formed on a top rim of the first hollow leg. A third and a fourth fastening members fasten the first and the second joints on the transverse plate. The first brace is fastened on a lower portion of the first hollow leg. The second brace is fastened on a lower portion of the second hollow leg. A first hook extends from a top end of the first bracket to be inserted in the first brace. A second hook extends from a top end of the second bracket to be inserted in the second brace. However, the hollow leg will be detached from the respective joint if the user extends the hollow leg to the utmost.

SUMMARY OF THE INVENTION

An object of the present invention is to provide a musical instrument stand which can be folded easily.

Yet another object of the present invention is to provide a musical instrument stand which can stand stably.

Accordingly, a musical instrument stand comprises a pair of first leg devices, a pair of second leg devices, a pair of adjustment mounts, a main connector, a collar, a clamping device, and an adjustment tube. A first rivet fastens one of the first leg devices, one of the second leg devices, and one of the adjustment mounts together. A bolt fastens the main connector and one of the adjustment mounts together. The clamping device has a lower sleeve. The collar receives the lower sleeve of the clamping device. The clamping device receives an upper portion of the main connector. The adjustment tube is inserted through the clamping device and the main connector.

DETAILED DESCRIPTION OF THE INVENTION

Figure 1:
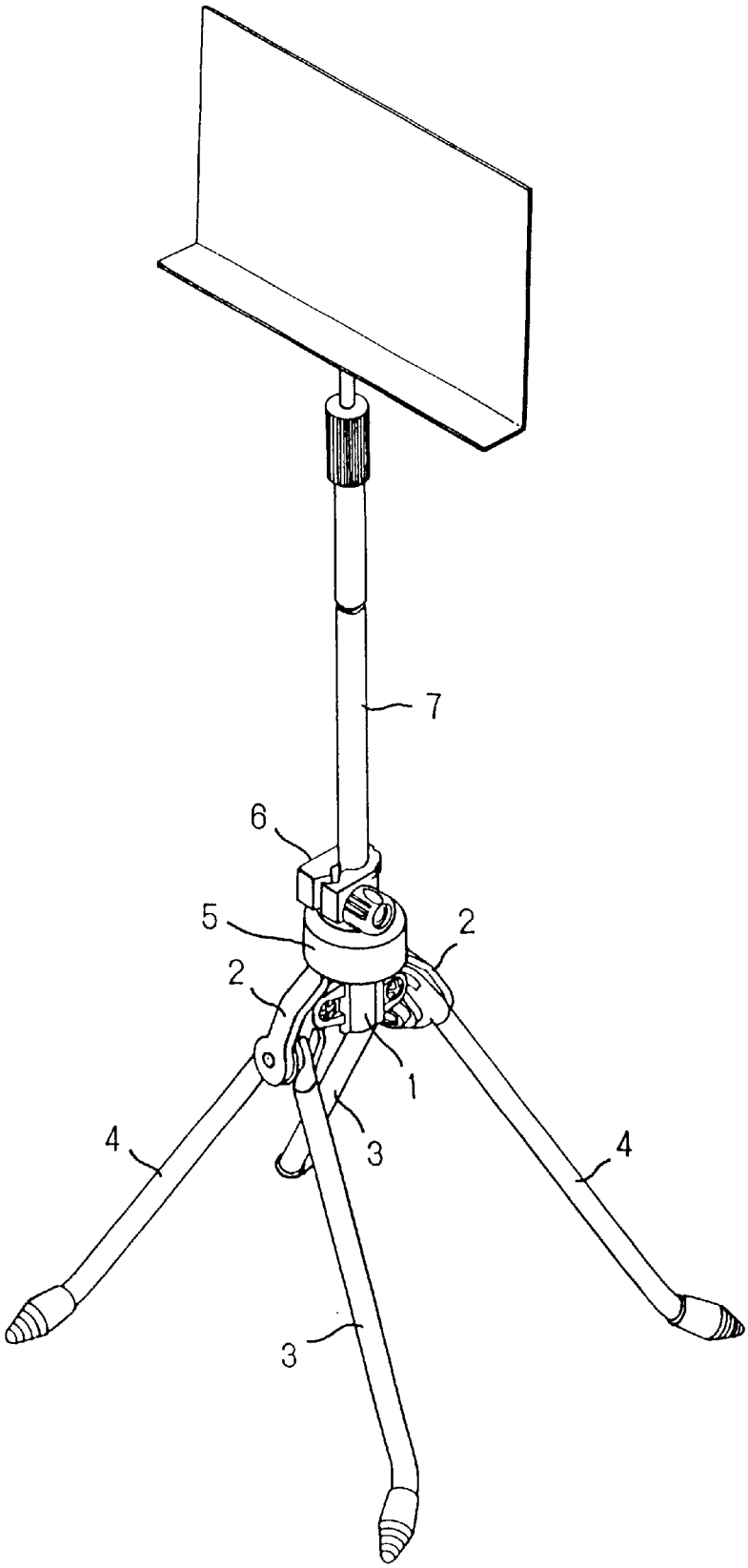
FIG. 1 is a perspective assembly view of a musical instrument stand of a first preferred embodiment in accordance with the present invention.
Figure 2:
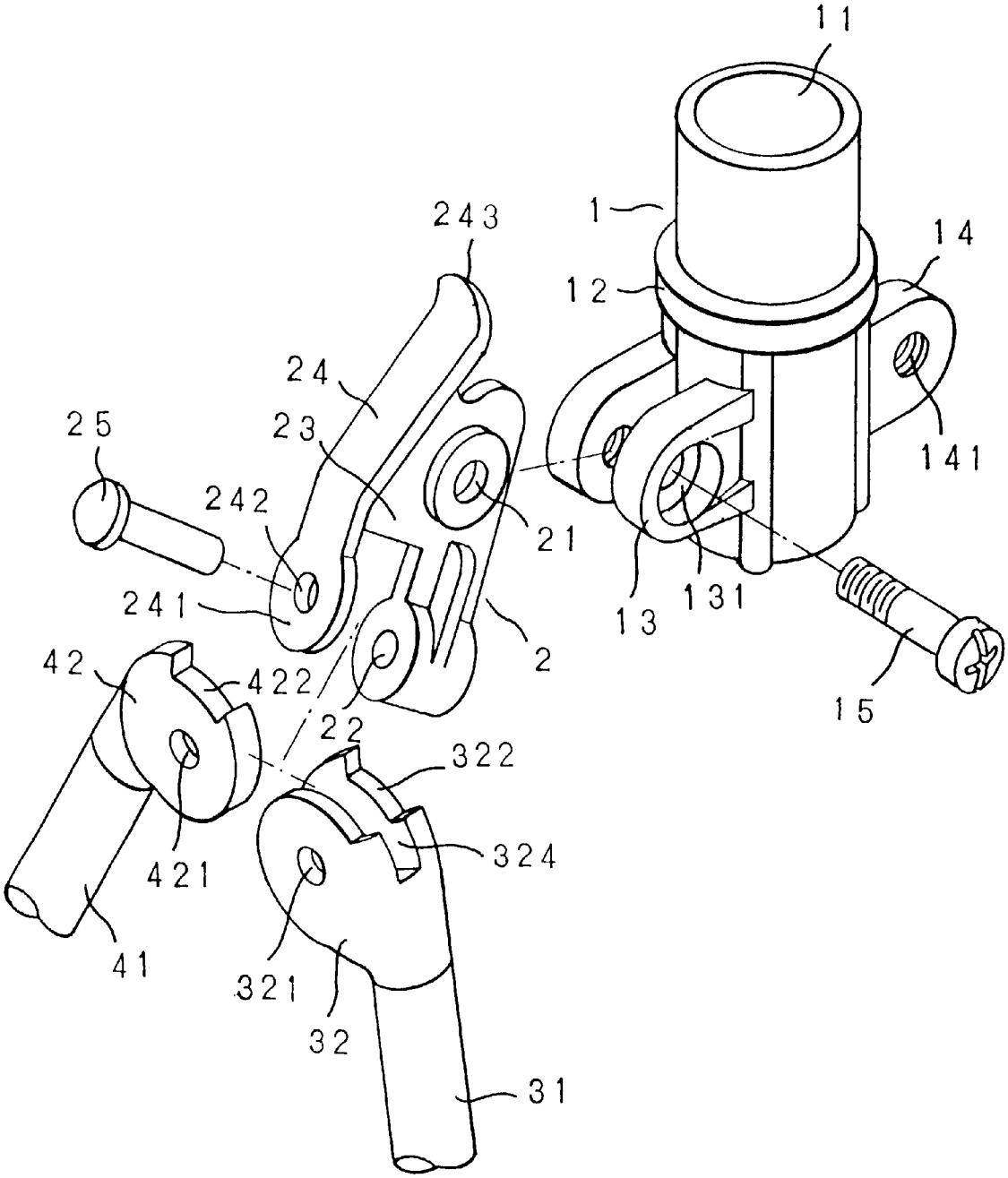
FIG. 2 is a perspective exploded view of a main connector, an adjustment mount, a tube, and a pipe of a first preferred embodiment in accordance with the present invention.
Figure 3:
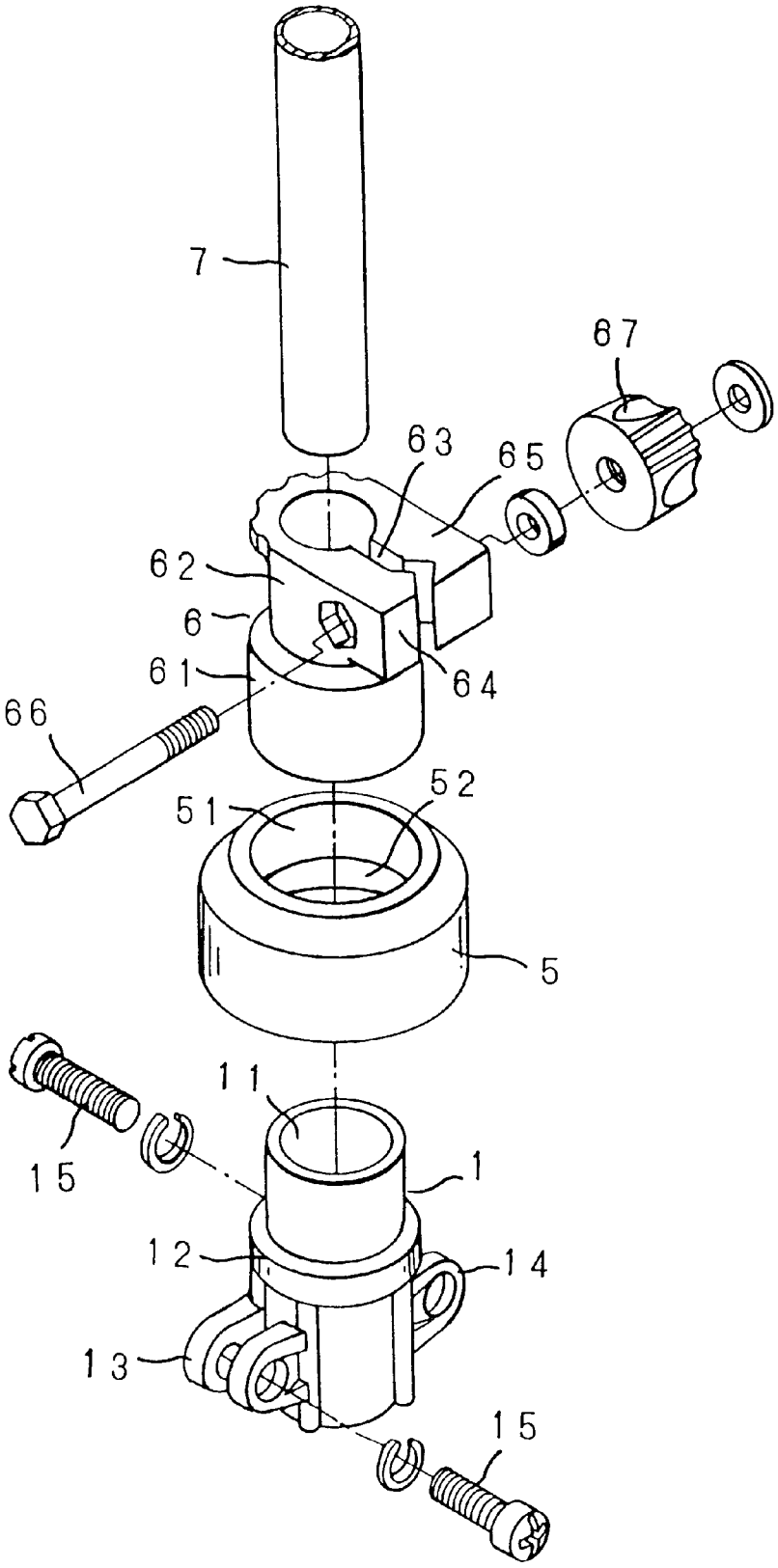
FIG. 3 is a perspective exploded view of a main connector, a collar, a clamping device, and an adjustment tube of a first preferred embodiment in accordance with the present invention.
Figure 4:
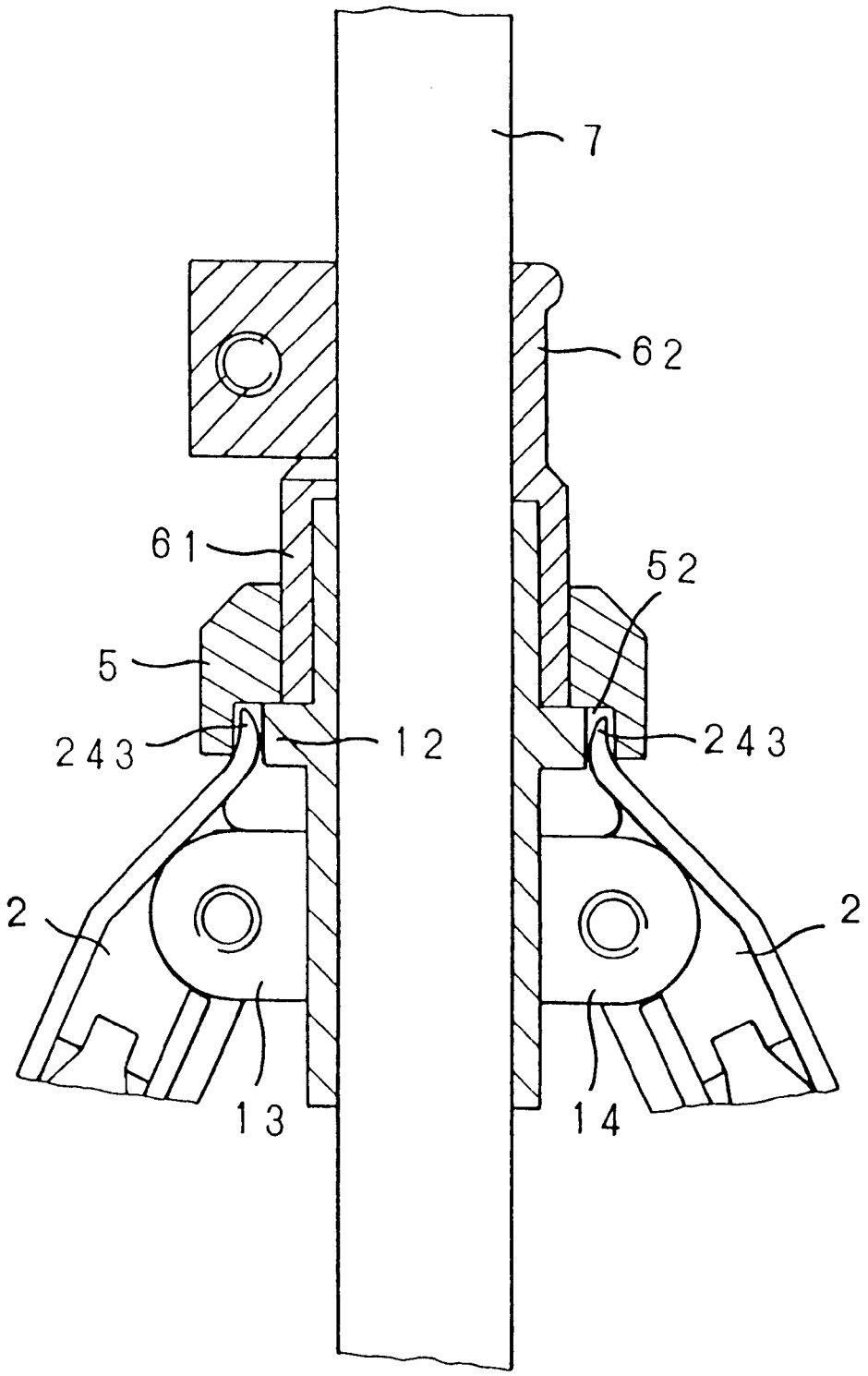
FIG. 4 is a sectional assembly view of a main connector, a collar, a clamping device, and an adjustment tube of a first preferred embodiment in accordance with the present invention.

Referring to FIGS. 1 to 4, a first musical instrument stand comprises a pair of first leg devices 3, a pair of second leg devices 4, a pair of adjustment mounts 2, a main connector 1, a collar 5, a clamping device 6, and an adjustment tube 7.

Each of the first leg devices 3 has a leg pipe 31 and a first joint 32 disposed on the leg pipe 31.

Each of the second leg devices 4 has a leg tube 41 and a second joint 42 disposed on the leg tube 41.

The first joint 32 has an upper recess 322, a slot 324, and a first circular aperture 321 communicating with the slot 324.

The second joint 42 has an upper groove 422 and a second circular aperture 421 matching the first circular aperture 321 of the first joint 32.

The second joint 42 is inserted in the slot 324 of the first joint 32.

The main connector 1 has a through hole 11, a ring 12 surrounding a middle portion of the main connector 1, a pair of parallel first lugs 13, and a pair of parallel second lugs 14.

Each of the parallel first lugs 13 has a threaded hole 131.

Each of the parallel second lugs 14 has a threaded aperture 141.

Each of the adjustment mounts 2 has a blocking plate 23 having an upper round aperture 21 and a lower round aperture 22, and a lateral positioning bar 23 having an upper end 243 and a lower lug 241.

The lower lug 241 has a pivot aperture 242.

One adjustment mount 2 is disposed between the parallel first lugs 13.

The other adjustment mount 2 is disposed between the parallel second lugs 14.

The collar 5 has an upper round hole 51 and a lower circular hole 52 communicating with the upper round hole 51.

The clamping device 6 has a lower sleeve 61 and a hollow clamping block 62 disposed on the lower sleeve 61.

The hollow clamping block 62 has a first arm 64, a second arm 65, and a slit 63 formed between the first arm 64 and the second arm 65.

The collar 5 receives the lower sleeve 61 of the clamping device 6.

The clamping device 6 receives an upper portion of the main connector 1.

The adjustment tube 7 is inserted through the clamping device 6 and the main connector 1.

A screw rod 66 passes through the first arm 64 and the second arm 65.

A threaded button 67 engages with the screw rod 66.

A first rivet 25 fastens one of the first leg devices 3, one of the second leg devices 4, and one of the adjustment mounts 2 together through the pivot aperture 242, the first circular aperture 321, the second circular aperture 421, and the lower round aperture 22.

A bolt 15 fastens the main connector 1 and one of the adjustment mounts 2 together through the threaded hole 131 and the upper round aperture 21.

Figure 12:
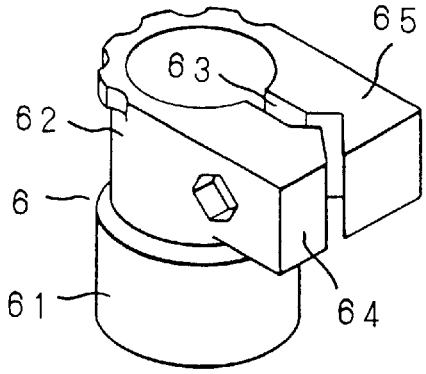
FIG. 12 is a perspective view of a clamping device of a first preferred embodiment in accordance with the present invention.
Figure 13:
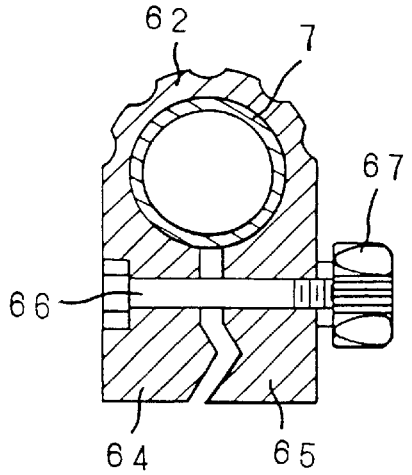
FIG. 13 is a sectional view of FIG. 12.
Figure 14:
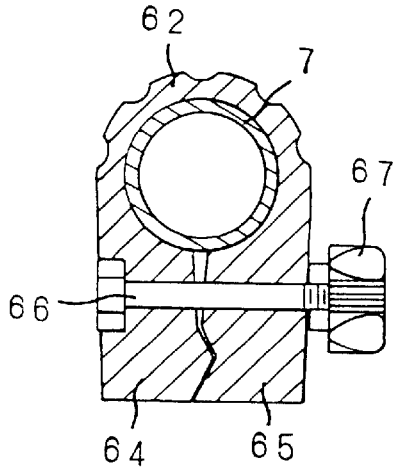
FIG. 14 is a schematic view illustrating a screw rod and a threaded button fastening a clamping device tightly.
Figure 15:
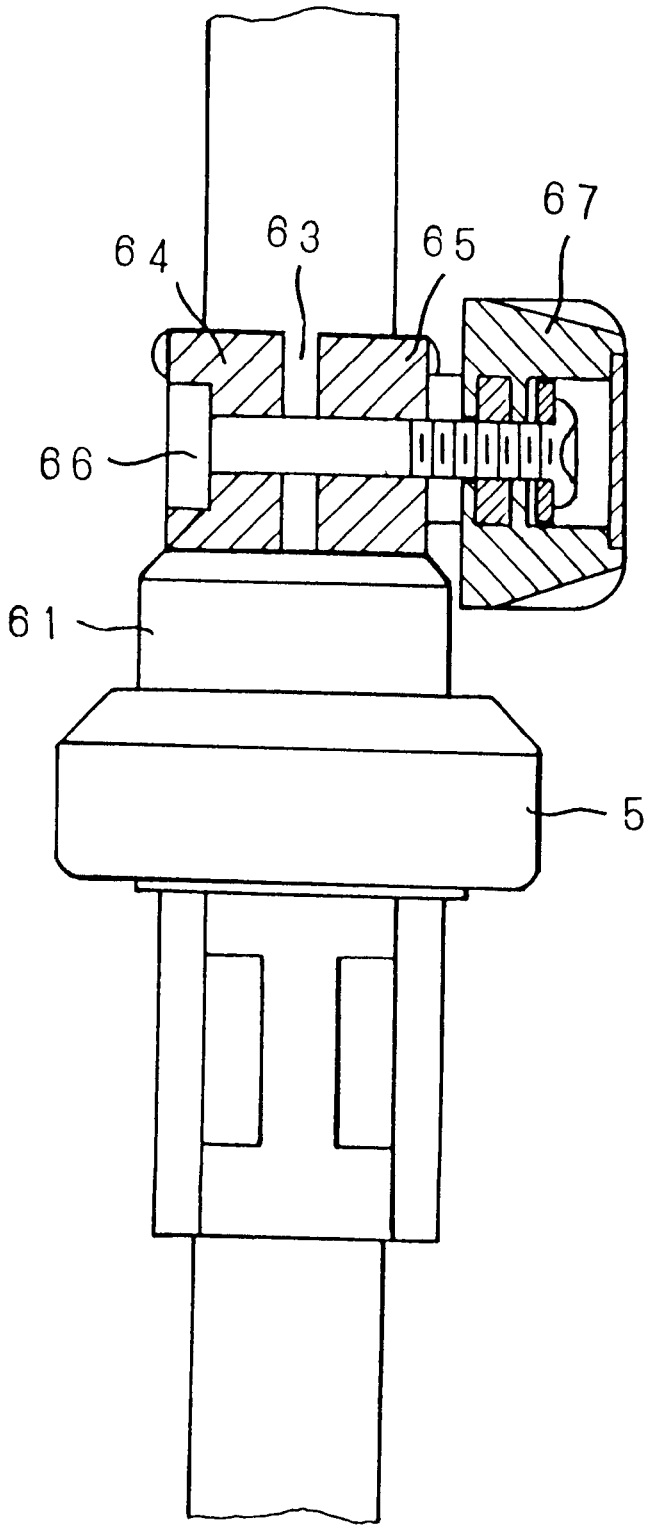
FIG. 15 is another sectional view of FIG. 12.

Referring to FIGS. 12 to 15, the slit 63 is in a zigzag shape.

Figure 5:
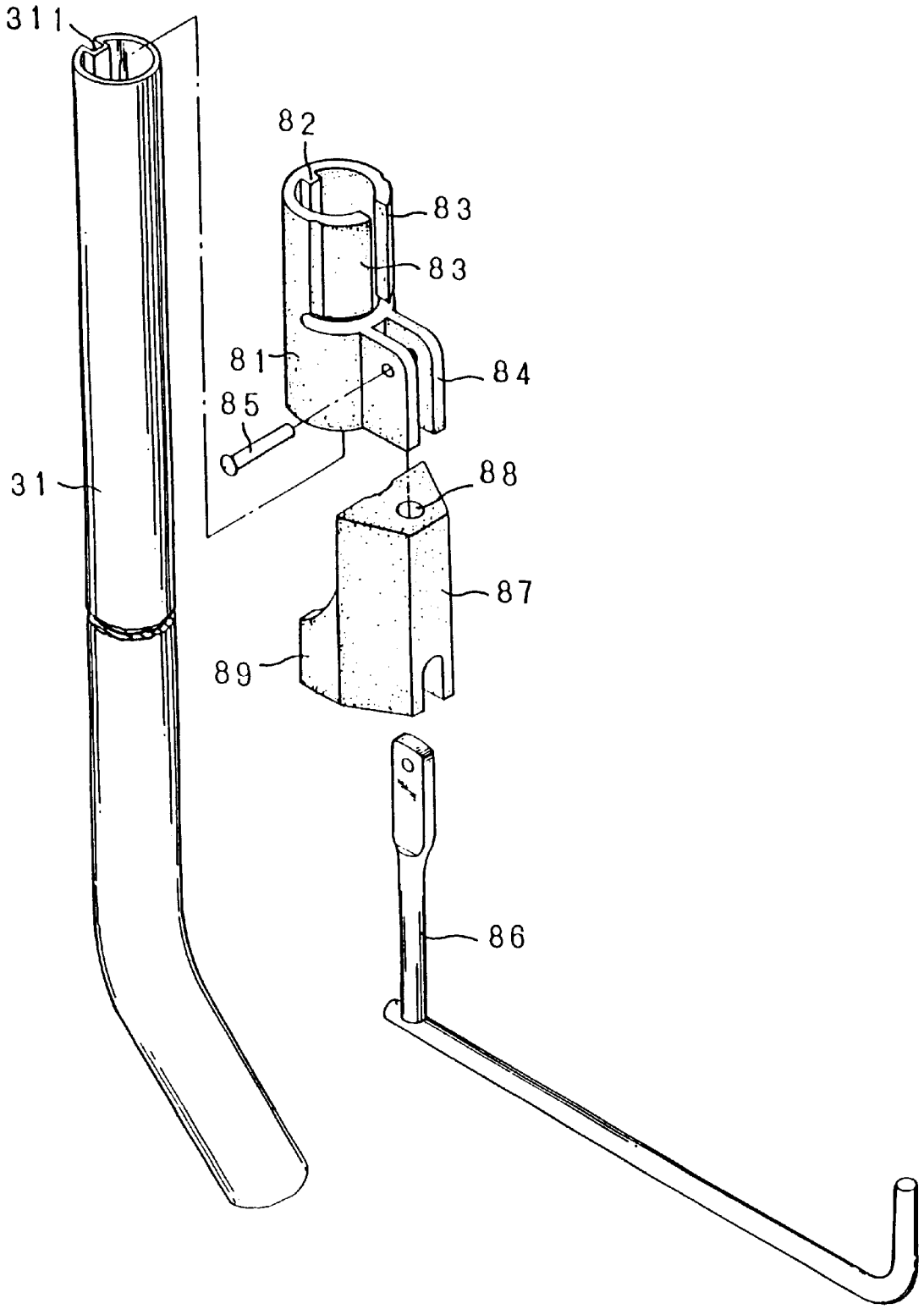
FIG. 5 is a perspective exploded view of a leg pipe, an annular casing, a support block, and a bracket.
Figure 6:
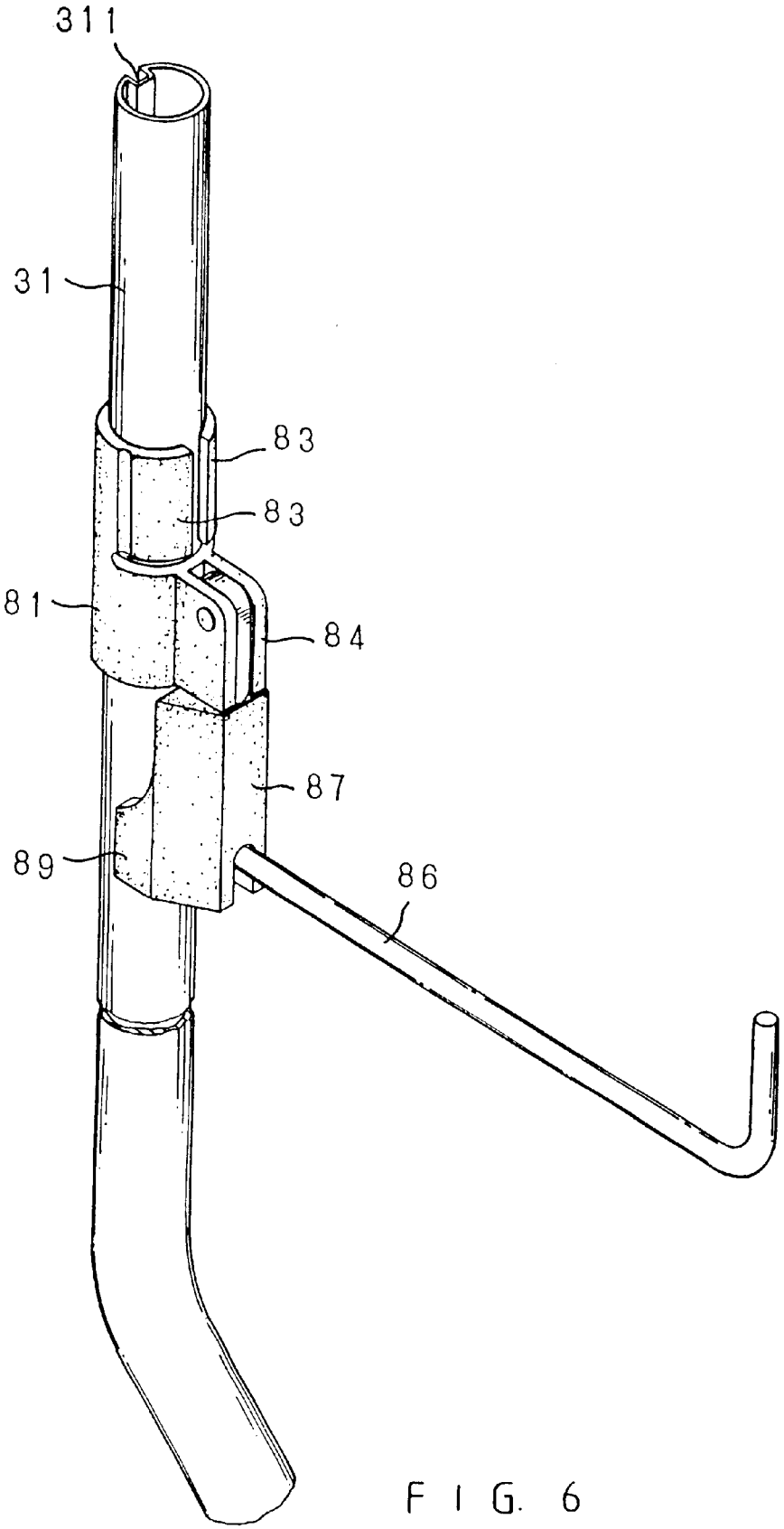
FIG. 6 is a perspective assembly view of a leg pipe, an annular casing, a support block, and a bracket.
Figure 7:
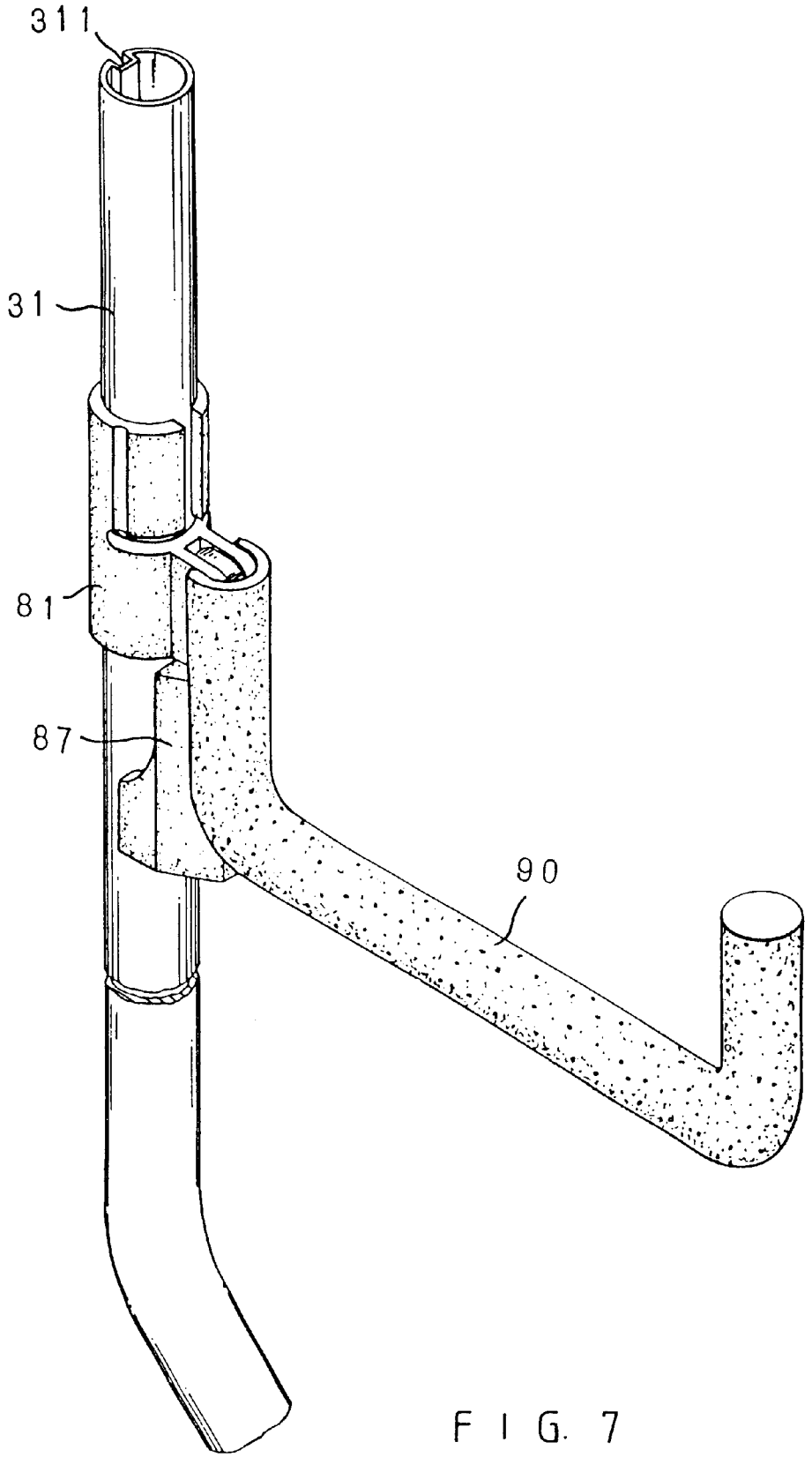
FIG. 7 is a schematic view illustrating an outer casing enclosing a bracket and a support block.
Figure 8:
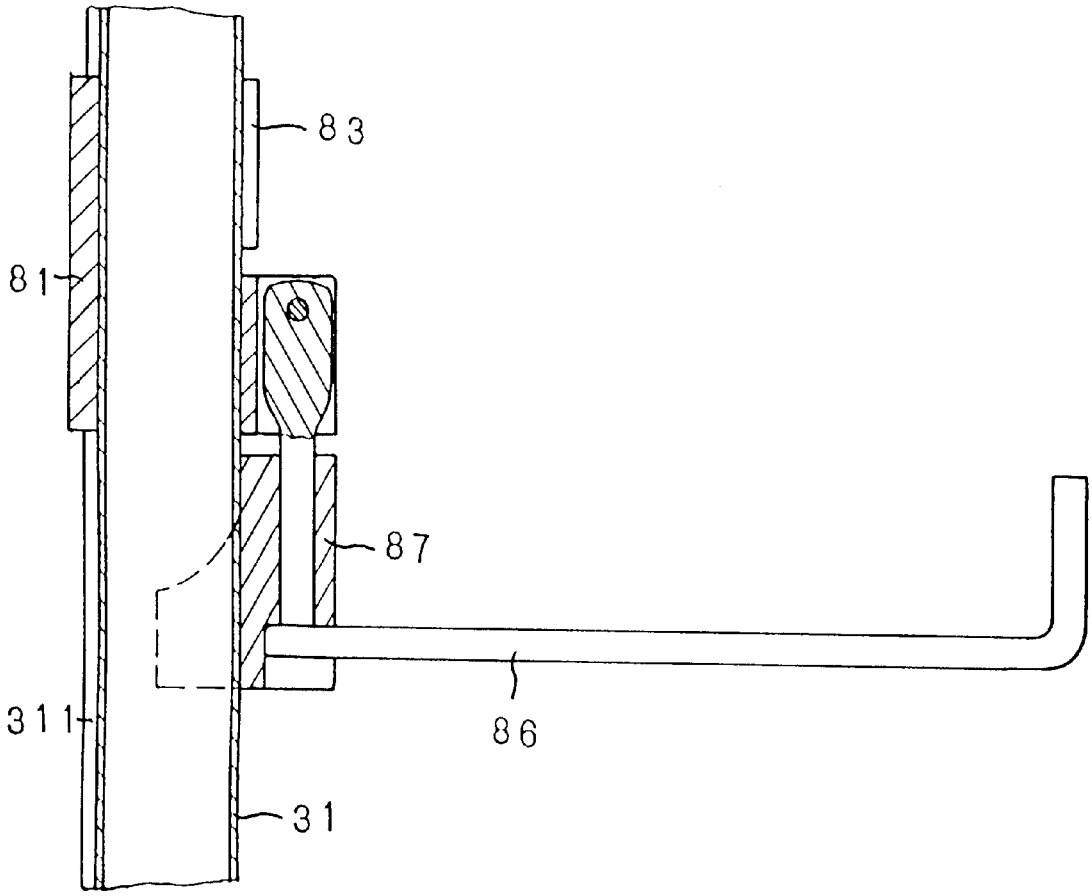
FIG. 8 is a sectional assembly view of a leg pipe, an annular casing, a support block, and a bracket.
Figure 9:
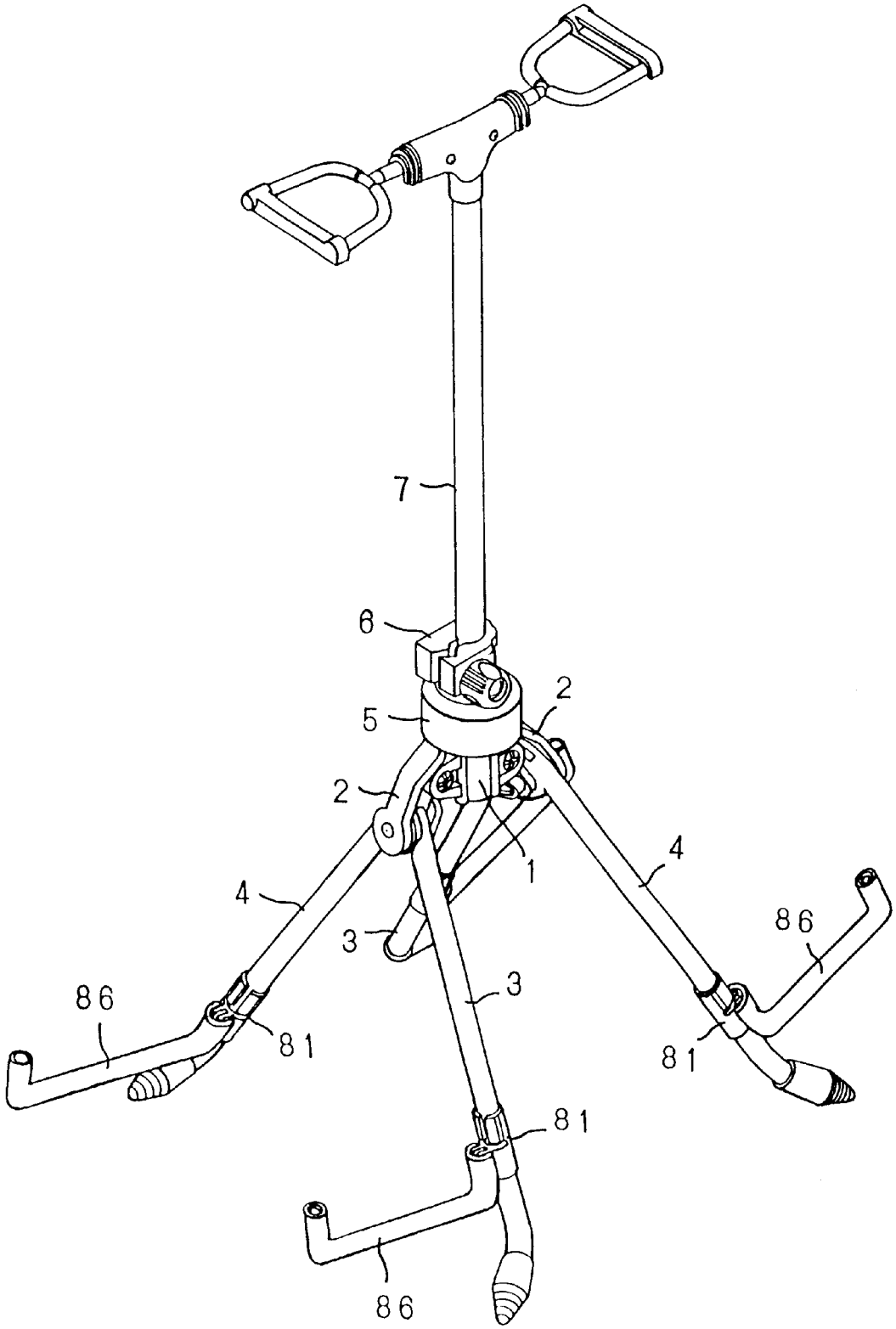
FIG. 9 is a perspective assembly view of a musical instrument stand of a second preferred embodiment in accordance with the present invention.
Figure 10:
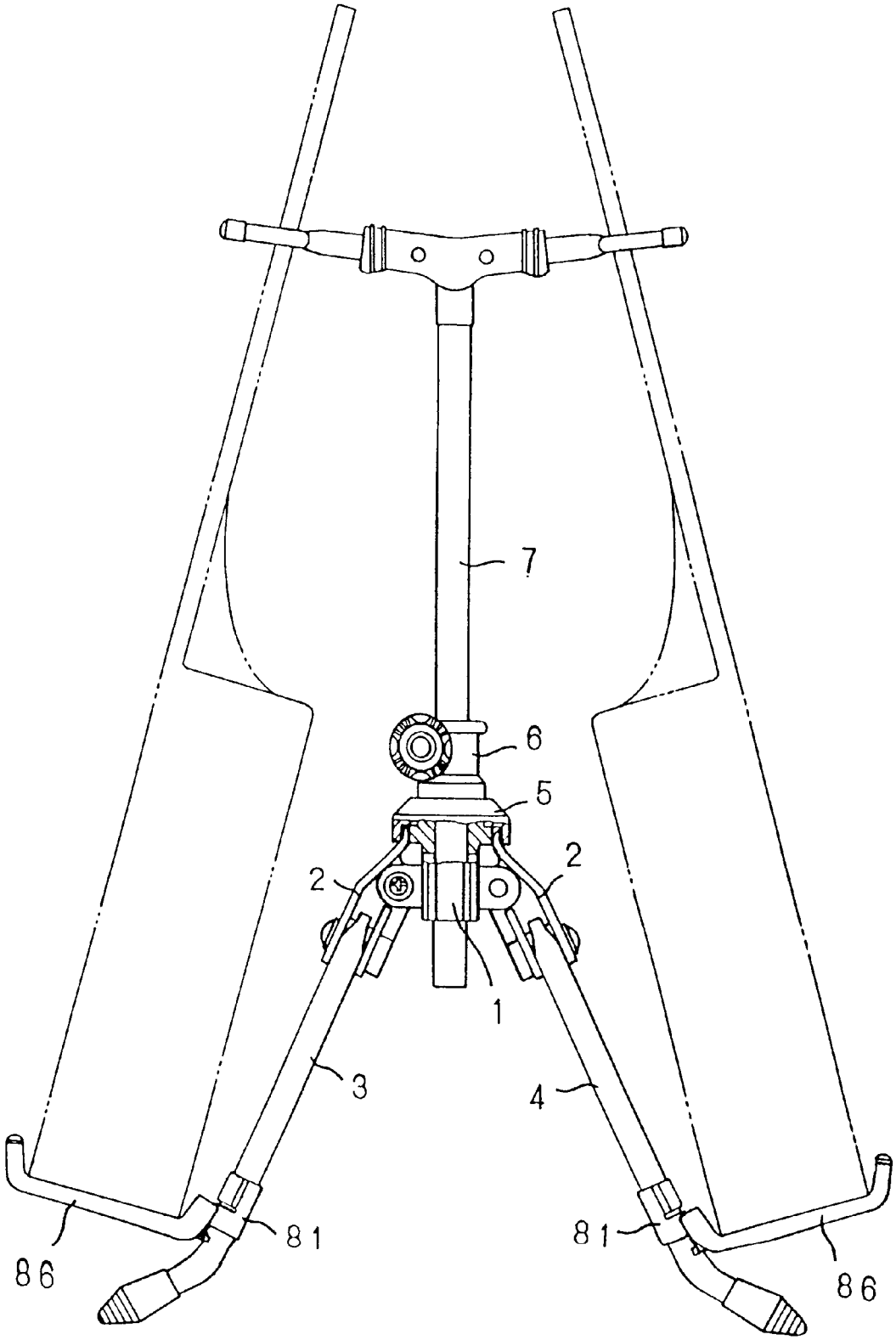
FIG. 10 is an elevational view of a musical instrument stand of a second preferred embodiment in accordance with the present invention.
Figure 11:
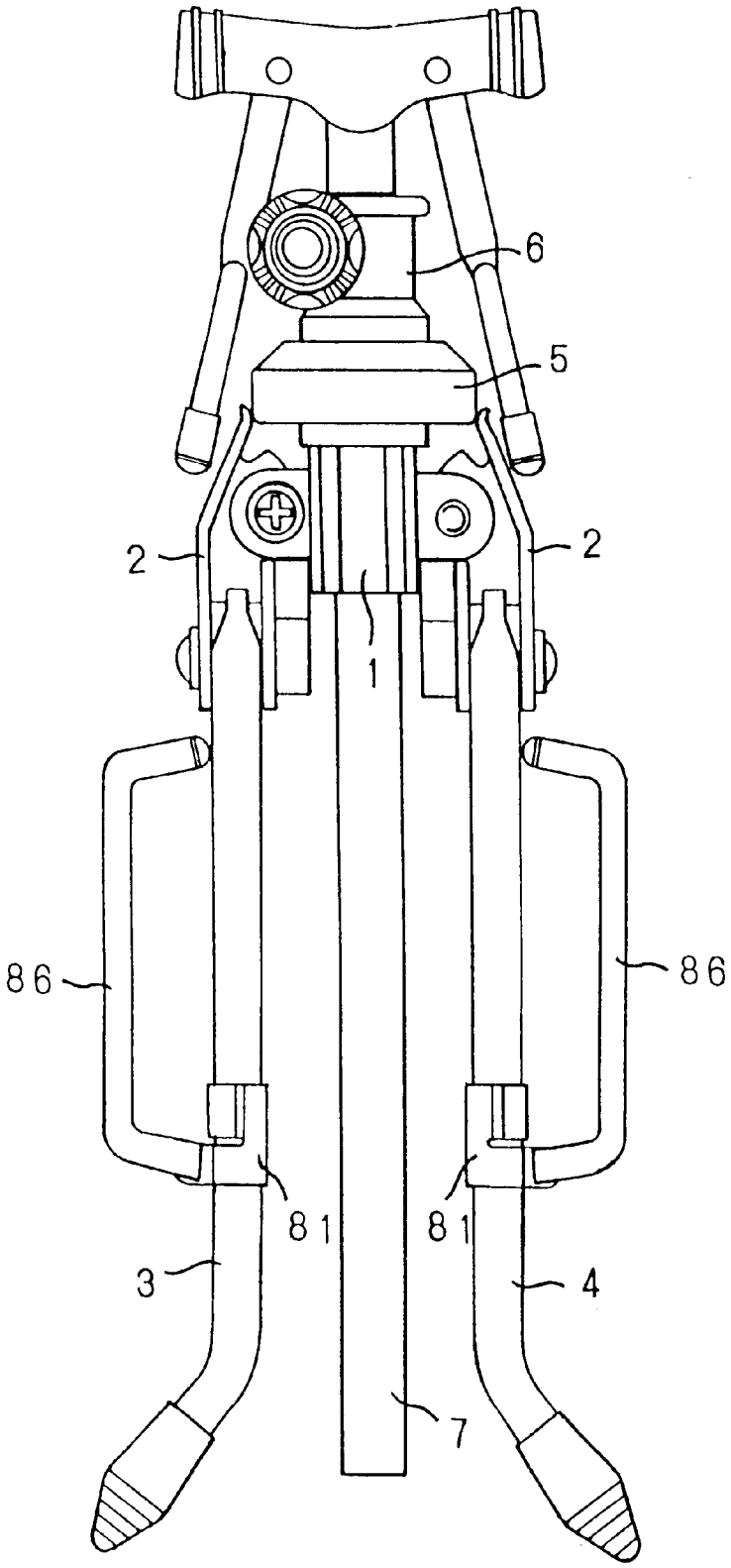
FIG. 11 is a schematic view illustrating a musical instrument stand of a second preferred embodiment is folded.

Referring to FIGS. 5 to 11, each of the leg pipes 31 has a periphery channel 311.

An annular casing 81 encloses the corresponding leg pipe 31.

The annular casing 81 has an inner flange 82, two upper elastic plates 83, and two lower braces 84.

A support block 87 has a through aperture 88 and two lower elastic bars 89 surrounding the corresponding leg pipe 31.

The support block 87 is disposed on a bottom of the annular casing 81.

The inner flange 82 of the annular casing 81 is inserted in the periphery channel 311 of the corresponding leg pipe 31.

An L-shaped bracket 86 passes through the through aperture 88 of the support block 87.

A second rivet 85 fastens the L-shaped bracket 86 and the lower braces 84 together.

An outer casing 90 encloses the L-shaped bracket 86 and the support block 87.

The present invention is not limited to the above embodiments but various modifications thereof may be made. Furthermore, various changes in form and detail may be made without departing from the scope of the present invention.

I claim:

1. A musical instrument stand comprises:

a pair of first leg devices, a pair of second leg devices, a pair of adjustment mounts, a main connector, a collar, a clamping device, and an adjustment tube, a first rivet fastening one of the first leg devices, one of the second leg devices, and one of the adjustment mounts together, a bolt fastening the main connector and one of the adjustment mounts together, the clamping device having a lower sleeve, the collar receiving the lower sleeve of the clamping device, the clamping device receiving an upper portion of the main connector, the adjustment tube inserted through the clamping device and the main connector, the clamping device further having a hollow clamping block disposed on the lower sleeve, the hollow clamping block having a first arm, a second arm, and a slit formed between the first arm and the second arm, the collar having an upper round hole and a lower circular hole communicating with the upper round hole, each of the first leg devices having a leg pipe and a first joint disposed on the leg pipe, each of the second leg devices having a leg tube and a second joint disposed on the leg tube, the first joint having an upper recess, a slot, and a first circular aperture communicating with the slot, the second joint having an upper groove and a second circular aperture matching the first circular aperture of the first joint, the second joint inserted in the slot of the first joint, an annular casing enclosing a corresponding leg pipe, the annular casing having two upper elastic plates and two lower braces, a support block having a through aperture and two lower elastic bars surrounding the corresponding leg pipe, the support block disposed on a bottom of the annular casing, and a bracket passing through the through aperture of the support block.

2. The musical instrument stand as claimed in claim 1, wherein an outer casing encloses the bracket and the support block.

* * * * *